United States Patent [19]

Burton

[11] Patent Number: 4,668,126

[45] Date of Patent: May 26, 1987

[54] FLOATING DRILLING RIG APPARATUS AND METHOD

[75] Inventor: James A. Burton, Houston, Tex.

[73] Assignee: Hydril Company, Los Angeles, Calif.

[21] Appl. No.: 832,581

[22] Filed: Feb. 24, 1986

[51] Int. Cl.[4] ..... E21B 7/12

[52] U.S. Cl. ..... 405/169; 166/341; 166/345; 405/195

[58] Field of Search ..... 405/168, 170, 171, 195; 166/338, 339, 340, 341, 342, 343, 344, 345, 350, 359, 367

[56] References Cited

U.S. PATENT DOCUMENTS

| | | | |
|---|---|---|---|
| 3,313,345 | 4/1967 | Fischer | 166/355 |
| 3,313,358 | 4/1967 | Postlewaite et al. | 175/7 |
| 3,322,191 | 5/1967 | Bullard | 166/352 |
| 3,502,143 | 3/1970 | Petersen | 166/355 |
| 3,722,585 | 3/1973 | Nelson et al. | 166/341 |
| 3,741,295 | 6/1973 | Murman et al. | 166/338 |
| 3,791,442 | 2/1974 | Watkins | 166/352 |
| 3,889,747 | 6/1975 | Regan et al. | 166/359 |
| 4,147,221 | 4/1979 | Ilfrey et al. | 166/367 |
| 4,428,433 | 1/1984 | Watkins | 166/339 |
| 4,502,543 | 3/1985 | Outhwaite | 166/359 |

FOREIGN PATENT DOCUMENTS

| | | | |
|---|---|---|---|
| 2097449 | 11/1982 | United Kingdom | 166/338 |

OTHER PUBLICATIONS

API Recommended Practice for Design and Operation of Marine Drilling Riser Systems, 1982, 36 pages.

1972–1973 Composite Catalog of Oil Field Equipment and Services, 4 pages.

*Primary Examiner*—Richard J. Scanlan, Jr.

*Assistant Examiner*—Kristina I. Hall

*Attorney, Agent, or Firm*—Dodge, Bush & Moseley

[57] ABSTRACT

The invention relates to a method and apparatus for remotely connecting or disconnecting upper flexible choke/kill lines (including auxiliary lines) to choke/kill lines of a floating drilling rig riser which has been lowered toward the sea floor. Remote stab assemblies are mounted to a stowable tension ring releasably secured to a housing secured to rig beams. In the stowed position, hydraulic stab connectors secured to travelling yoke assemblies are disconnected from each line. The travelling yoke assemblies are moved to an outer position so that the flexible drape hoses clear the space beneath the housing in order that a blowout preventer stack may be trolleyed in from the side of the rig moon pool during running or retrieval. The stack is lowered toward the sea floor by the riser. A telescopic joint is connected to the top of the riser and lowered through the housing and the tension ring. The tension ring is temporarily connected to the telescopic joint, disconnected from the housing and rides down with the telescopic joint while the stack, riser and telescopic joint are lowered until the stack is landed on the sea floor. The tension ring is then partially connected to the telescopic joint as the tension cables are pulled upwardly. Apparatus is provided for angularly and axially aligning the stab connectors with the choke/kill lines of the riser when the travelling yoke assemblies are moved inwardly where complete connection of the tension ring and telescopic joint is accomplished.

34 Claims, 11 Drawing Figures

FLOATING DRILLING RIG APPARATUS AND METHOD

BACKGROUND OF THE INVENTION

1. Field of the Invention

This invention relates in general to a method and apparatus for floating drilling rig operations. In particular, the invention relates to a remotely operable system for connecting or disconnecting upper flexible choke and kill lines to the choke and kill lines associated with the drilling riser system. Still more particularly, the invention relates to a method of assembling a blowout preventer stack and marine riser system from the sea floor to the drilling rig and to the equipment for connecting flexible choke/kill lines to the choke/kill lines secured to the marine riser.

2. Description of the Prior Art

In floating drilling systems, a blowout preventer stack system is connected to the wellhead at the sea floor and is connected to the drilling rig by means of a riser system. The riser system is an assembly of end-to-end connected riser lengths or "joints", each of which is constructed of seamless pipe with mechanical connectors welded on their ends. Choke/kill lines are attached to the riser lengths by extended flanges of the connectors.

In general, the riser is run in a manner similar to drill pipe, that is, by stabbing one riser length at a time into the string and tightening the connector. The choke/kill lines attached to the pipe of the riser lengths are made up simultaneously with the pipe, until the entire riser string runs from the blowout preventer stack at the sea floor to a position at the vessel where the riser system is completed by connecting flexible drape hoses to the choke/kill line. A telescopic joint, flex joint/diverter system, is connected to complete the drilling riser system.

In conventional systems, the blowout preventer stack is first landed on the sea floor and the riser string is constructed by connecting the riser lengths end to end. The choke/kill lines running parallel to the riser lengths at this time in the assembly face upwardly in the moon pool of the drilling vessel and are unterminated. They must be connected to flexible drape hoses by means of stab connectors. Prior art systems for such connection have required manual maneuvering of the heavy, awkward drape hoses and equipment into place with the assistance of various tugger lines.

Prior systems for connecting the drape hoses to the choke/kill lines of the riser have used pinned connections with associated loose parts and tools which can be lost overboard into the sea. These systems have required manual connection and tugger lines, often with a workman held by a sling beneath the rotary table in the moon pool. With such a system, the workman must struggle with drape hose bundles often weighing as much as 3,000 lbs.

Still other systems have provided for semi-automatic connection of the drape hoses to the choke/kill lines. But such systems have not provided a way for moving the drape hoses out of the interfering vicinity beneath the rotary table of the vessel so that the blowout preventer stack may be moved in the moon pool beneath the rotary table for connection to the riser in anticipation of lowering the riser and the stack to the sea floor.

IDENTIFICATION OF OBJECTIONS OF THE INVENTION

It is therefore an object of the invention to provide a terminal end assembly for connecting flexible drape hoses to the choke/kill lines of the riser which requires no manual handling and which may be remotely operated.

It is another object of the invention to provide a terminal end assembly which is provided as a complete unit and which may be hydraulically operated to move and position hydraulic stab connectors into position for connecting flexible drape hoses to the choke/kill lines and auxiliary lines associated with the riser.

It is another object of the invention to provide a terminal end assembly which has no loose parts or tools required for connecting the drape hoses to the choke/-kill lines of the riser.

It is still another object of the invention to provide a complete assembly for remotely connecting or disconnecting terminal connections between the riser choke/-kill line and auxiliary lines and flexible drape hoses at the drilling rig.

It is another object of the invention to provide a terminal end assembly which may be retracted from the immediate vicinity beneath the support housing of the drilling rig in order to provide room for trolleying a blowout preventer stack beneath the housing for connection to the riser in anticipation of lowering or raising the blowout preventer stack to or from the sea floor.

SUMMARY OF THE INVENTION

Apparatus according to the invention is provided for use with a floating drilling rig having a marine riser including a telescopic joint connected to a riser having an upwardly facing unterminated choke/kill line. The telescopic joint has at least one guide/index key. The apparatus includes a terminal end assembly which has a frame, at least one yoke slidably disposed on the frame for securing a drape hose terminated by a downwardly facing stab connector, and apparatus for moving the yoke between an outer position upon the frame and an inner position upon the frame. A slot is disposed on the yoke for accepting the guide/index key of the telescopic joint when the yoke is moved to the inner position.

A tension ring is secured to the frame and includes apparatus for securing the tension ring and the frame to the telescopic joint when the telescopic joint is disposed within the tension ring. Alignment apparatus is provided for aligning the guide/index key with the yoke slot operably insuring that the guide/index key is inserted into the yoke slot when the yoke is moved to the inner position and thereby operably angularly aligning the stab connector with the choke/kill line.

In operation, according to the invention, the hydraulic stab connectors of the terminal end assebly are unlocked and disconnected when the terminal end assembly is in the stowed position. The yoke assembly to which the stab connectors and associated flexible drape hoses are mounted are moved to an outer position so that the drape hoses clear the blowout preventer stack assembly beneath the rig support housing. This operation allows the blowout preventer stack to be trolleyed in from the side of the rig moon pool into position under the rotary/diverter/tension ring/terminal end assembly. The blowout preventer stack is then lowered on the drilling riser length by length as it is run into the sea. At the top of the riser the telescopic joint is installed and the tension ring is engaged with the outer barrel of the telescopic joint. Such engagement is achieved by actuating dogs which are disposed about the inner periphery of the tension ring into a groove disposed about the outer periphery of the outer barrel of the telescopic joint. The tension ring is then disconnected from the support housing, and the blowout preventer stack and the riser with the tension ring and terminal end assembly being carried by the dogs within the groove, are lowered until the blowout preventer stack is landed and connected to a wellhead at the sea floor. The tension ring is then raised by tension cables until the dogs are secured at the top of the groove.

Terminal end assembly yokes according to the invention are then moved to an inner position bringing the hydraulic stab connectors into position over mating male pin connectors of the choke/kill lines secured to the riser. Angular alignment of the terminal end assembly with respect to the telescopic joint is accomplished by rotating the terminal end assembly, now partially connected to the telescopic joint with respect to the tension ring by a motor secured to the tension ring for driving a sprocket engaging a chain on a mounting plate of the terminal end assembly. Such motor is only used if the angular misalignment between the yoke and telescopic joint is more than plus or minus eight degrees ($\pm 8°$). A misalignment of less than plus or minus eight degrees is automatically corrected with a guide/index key on the telescopic joint engaging a guide/index slot in the yoke assembly. The index key assures that when the yoke assemblies are in the fully inward position, the hydraulic connectors are angularly aligned with the pin connectors of the riser.

The telescopic joint and the tension ring are thus axially and angularly positioned with respect to each other and are secured to each other, with the hydraulic stabs vertically and angularly aligned. The hydraulic stabs are then actuated to engage the mating pin stabs of the riser.

The tension ring includes inner and outer rings rotatably mounted with respect to each other by a fluid bearing. After the terminal end assembly and the inner ring of the tension ring are connected to the telescopic joint and pressurized fluid is applied to the fluid bearing, the outer ring, and the tension cables attached to it, may be rotated with respect to the inner ring, operably aligning the tension cables when the floating drilling rig has changed orientation with respect to the riser.

BRIEF DESCRIPTION OF THE DRAWINGS

The objects, advantages and features of the invention will become more apparent by reference to the drawings which are appended hereto and wherein like numerals indicate like parts and wherein an illustrative embodiment of the invention is shown, of which:

FIGS. 1–4 show the method of installing a blowout preventer and riser system on a floating drilling rig to the sea floor according to the invention, and wherein FIG. 1 illustrates the attachment of a blowout preventer subsea stack to a length of riser at the moon pool of a floating drilling rig and where the flexible drape hoses and stab connectors have been moved outwardly to provide for such connection, FIG. 2 illustrates the lowering of the blowout preventer stack by means of connected lengths of riser pipes, FIG. 3 illustrates the lowering of the blowout preventer stack to a position near the bottom of a guide base and the connection of an outer barrel of a telescopic joint to the uppermost length of riser pipe, and FIG. 4 illustrates the connection of the flexible drape hoses to the choke/kill lines of the riser once they have been moved inwardly and illustrates the support via tension cables of a stowable tension ring connected to the outer barrel of a telescopic joint;

DESCRIPTION OF THE INVENTION

FIGS. 1–4 illustrate a terminal end assembly and a stowable tension ring according to the invention which cooperate with floating drilling rig systems for remotely controlling the angular and axial alignment of stab connectors connected to flexible drape hoses for connection to the choke/kill lines of a riser system after it has been installed atop a blowout preventer stack which has been lowered into the sea and landed on a guide frame/wellhead on the sea floor. In particular, the terminal end assembly may be remotely controlled to move outwardly and inwardly with respect to the space beneath the support housing of the drilling rig so as to enable the trolleying in or out of a blowout preventer stack at the moon pool beneath the support housing for connection to or disconnection from lengths of risers extending toward the sea floor.

Figure 1:
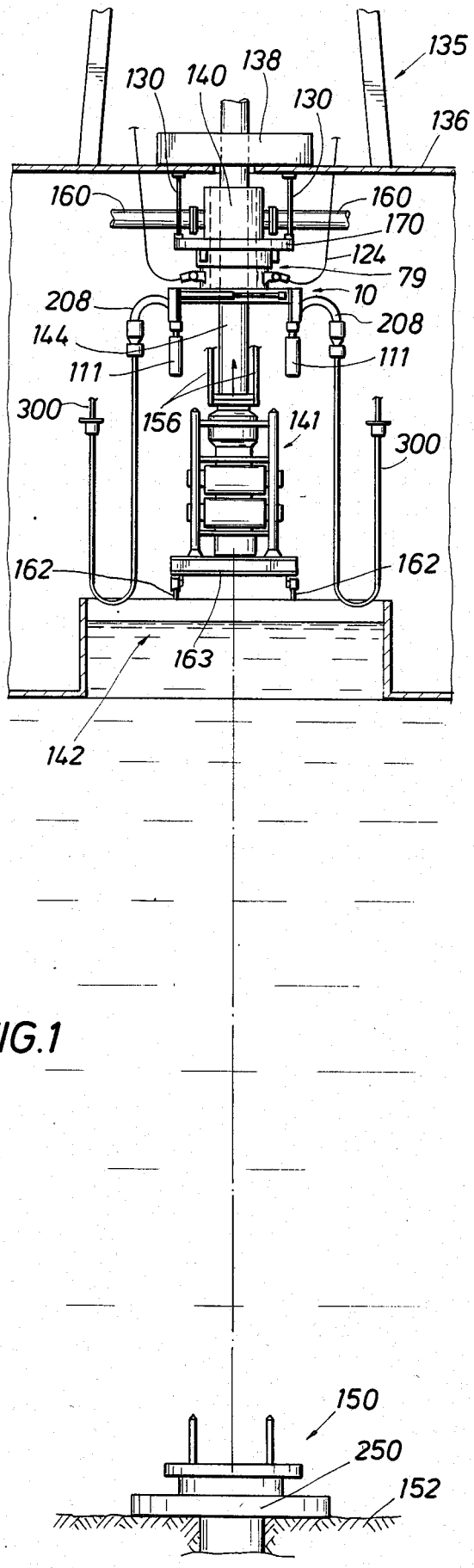

FIG. 1 illustrates the terminal end assembly 10 and the stowable tension ring 79 according to the invention secured to rig support beams 130 by means of a support ring 170. As illustrated, a diverter housing 140 is disposed beneath the rotary table 138 of rig 135 (partially illustrated) beneath deck 136 of the floating drilling rig. The support 170 may alternatively be the base plate of diverter housing 140. The diverter housing 140 is constructed to support a diverter connected to the top of the marine riser system. Such a diverter housing and diverter is illustrated in U.S. Pat. No. 4,444,401, which is incorporated herein. A divert line 158 and a flow line 160 are shown as may be connected to the side of the diverter housing 140.

A blowout preventer stack 141 is shown having been trolleyed to or from the space beneath the support housing 140 and rotary table 138 on moon pool beams 162. The stack 141 is moved on trolley 163 on beams 162 from a direction perpendicular to the plane of the illustration of FIG. 1. The terminal end assembly 10 in the condition illustrated in FIG. 1, has its stab connectors 111 and their associated flexible drape hoses 300 moved outwardly so as to provide sufficient space beneath the diverter housing 140 for the blowout preventer stack 141 to be moved into position in the moon pool 142 beneath diverter housing 140 and for connection of a length of riser 144 to the top of the blowout preventer stack 141. The lengths of riser 144 are inserted through the diverter housing 140 and are made up end-to-end to form a series of riser pipe lengths.

An important advantage of the invention is illustrated in FIG. 1 in that the flexible drape hoses 300 are moved completely away from the space beneath the support housing during the connection or disconnection of the blowout preventer stack 141 to a length of riser 144 thereby facilitating the connecting (or disconnecting) and lowering (or raising) of the blowout preventer stack 141 in the moon pool 142. As illustrated, the stowable tension ring 79 according to the invention includes tension cables 124 which are illustrated as being in a slack position when the stowable tension ring 79 is releasably supported to the support ring 170. The tension cables 124 are attached to the tension brackets 122 of the tension ring 79.

Beneath the rotary table and diverter housing, a guide base 150 disposed on the sea floor 152, includes male guide posts and means for guiding the blowout preventer stack 141 into the guide base, but such guiding means, such as guide lines, are not illustrated for purposes of simplicity. The blowout preventer stack 141 includes a frame having female tubes for landing upon the guide base guide posts. Also illustrated are the choke/kill lines 156 associated with the lengths of the riser 144 which are attached to the blowout preventer stack 141. It should be emphasized that the use of the designation "choke/kill lines" also includes any other auxiliary lines which may be attached to the lengths of the riser pipe 144 and which may be used to communicate with the blowout preventer stack 141 and other equipment.

Figure 2:
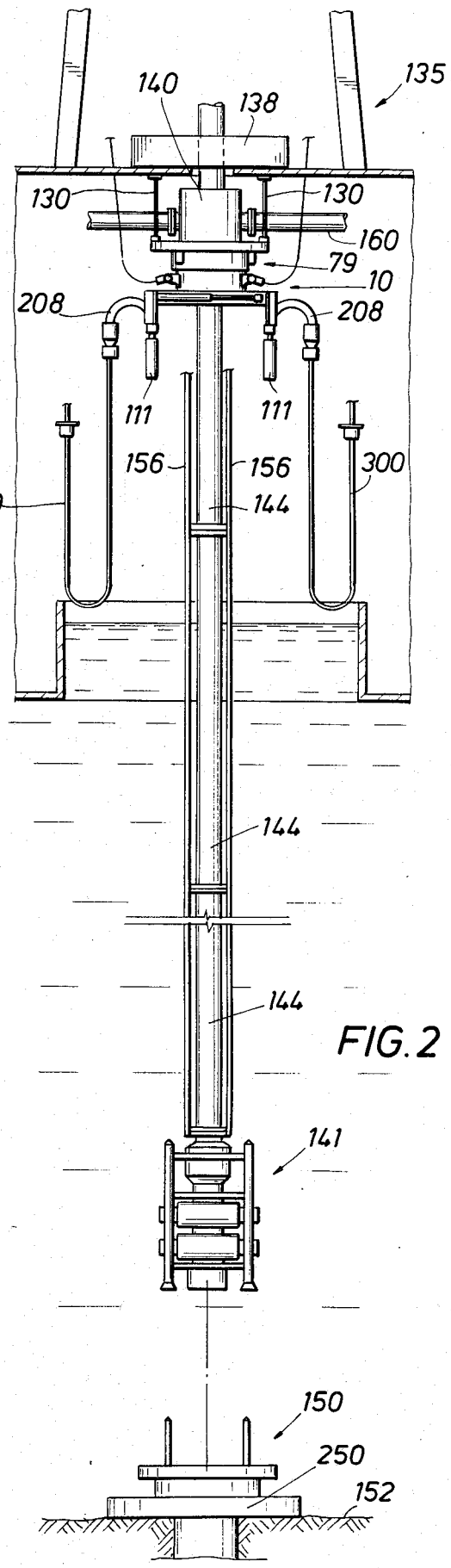

FIG. 2 illustrates the lowering of the blowout preventer stack 141 after it has been attached to several lengths of riser pipe 144. The blowout preventer stack trolley 163 and beams 162 have now been removed from beneath the diverter housing 140 and successive lengths of riser pipe 144 and choke/kill lines 156 have been connected end to end and lowered through the rotary table and diverter housing 140 until the blowout preventer stack 141 is nearing the guide base 150 at the sea floor 152. In this stage of the operation of landing the blowout preventer stack 141 in the guide base 150, the tension ring 79 and the terminal end assembly 10 are essentially in the same condition as that illustrated in FIG. 1: the stab connectors 111 and their associated drape hoses 300 remain in their outer position and the stowable tension ring 79 remains connected to the support ring 170 and the rig beams 130.

Figure 3:
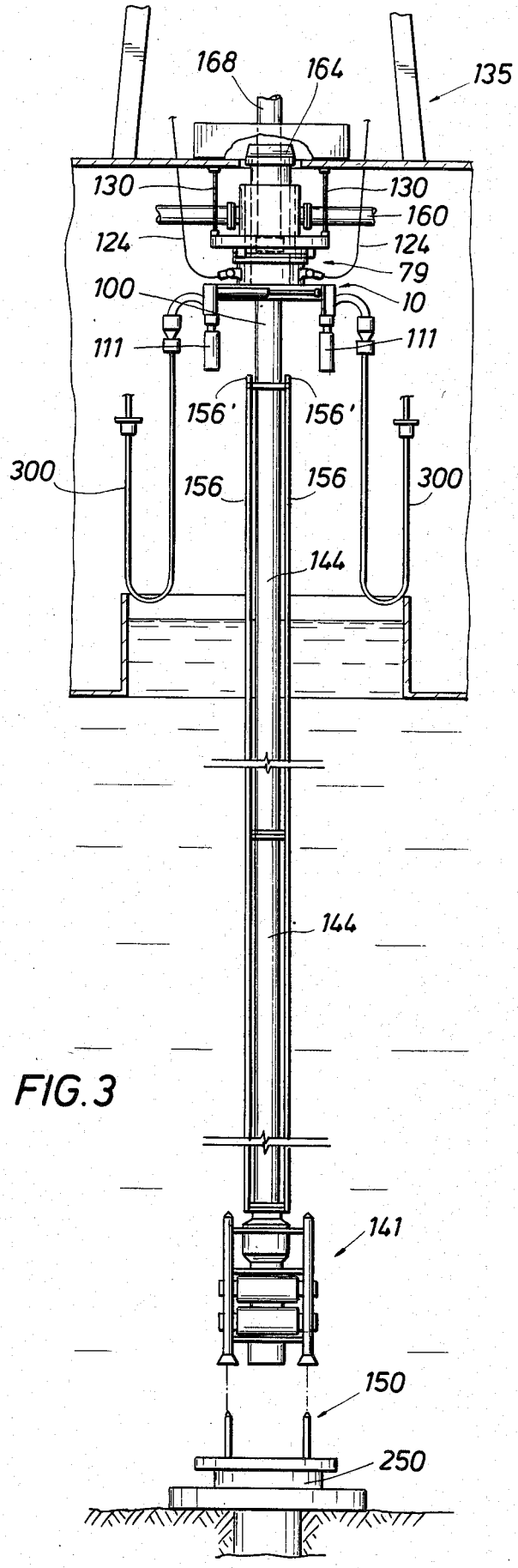

FIG. 3 illustrates the condition of the system as the blowout preventer stack 141 is nearing connection to the wellhead 250 at the sea floor 152 and illustrates that the outer barrel 164 of the telescopic joint has been lowered through the support housing 140 and the stowable tension ring 79. The outer barrel 164 of the telescopic joint has a tubular extension 100 connected to the tubular body of the uppermost riser length 144. FIG. 3 also illustrates the installation condition of the riser system where the unterminated pin members 156' face upwardly and preferably are part of extension 100 and connected to choke/kill lines 156 of the uppermost riser length 144. Pin members 156' face upwardly toward the stab connectors 111 which remain in the outer position of the terminal end assembly 10. The inner barrel of the telescopic joint 168 is slidingly provided within the outer barrel 164 and, in the condition of FIG. 3, the tension cables 124 remain in the slack condition, because the stowable tension ring 79 remains supported to the rig beams 130.

Figure 4:
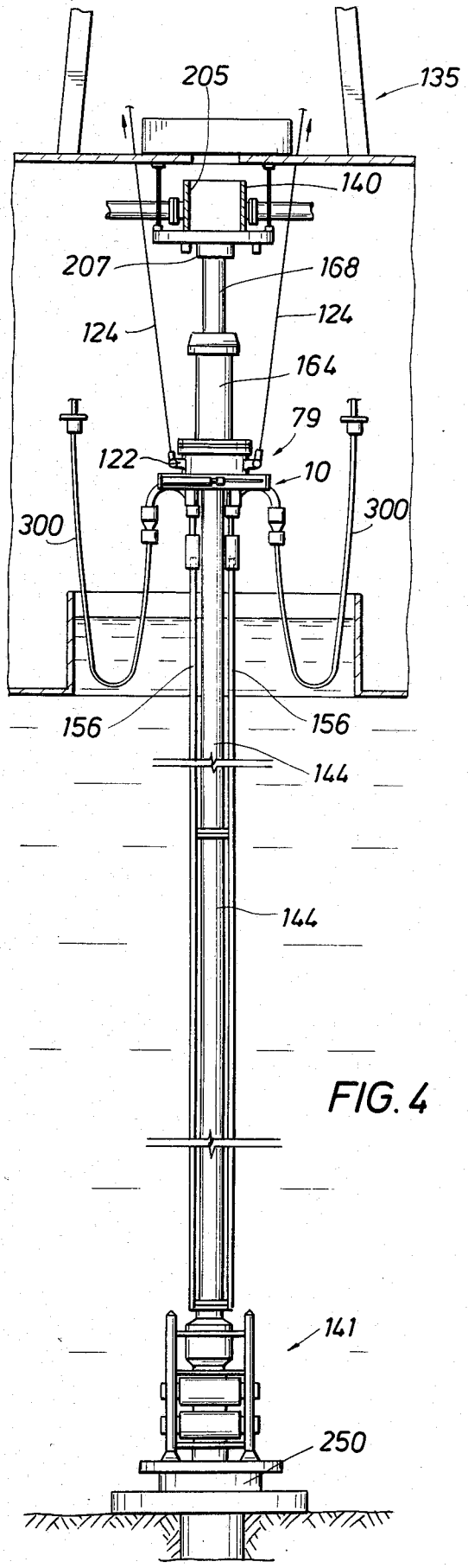

FIG. 4 illustrates the condition of the system with the blowout preventer stack landed on frame or guide base 150 and after the stab connectors 111 have been moved to their inner position and angularly and axially aligned and connected with the upwardly facing pin ends 156' and after the stowable tension ring 79 has been secured to the outer barrel 164 of the telescopic joint and disconnected from supporting ring 170. FIG. 4 also illustrates that the outer barrel 164 of the telescopic joint is being supported by tension cables 124 attached to the tension ring 79. The tension cables 124 in this condition support the entire riser system and are controlled by means of winches and tension compensators (not illustrated) in a conventional manner on the rig 135. A diverter 205 is illustrated as having been inserted within the diverter housing 140 and a flex joint 207 is shown as having been connected to the inner barrel 168 of the telescopic joint to complete the blowout preventer/-riser diverter system of the floating drilling rig system.

Figure 5:
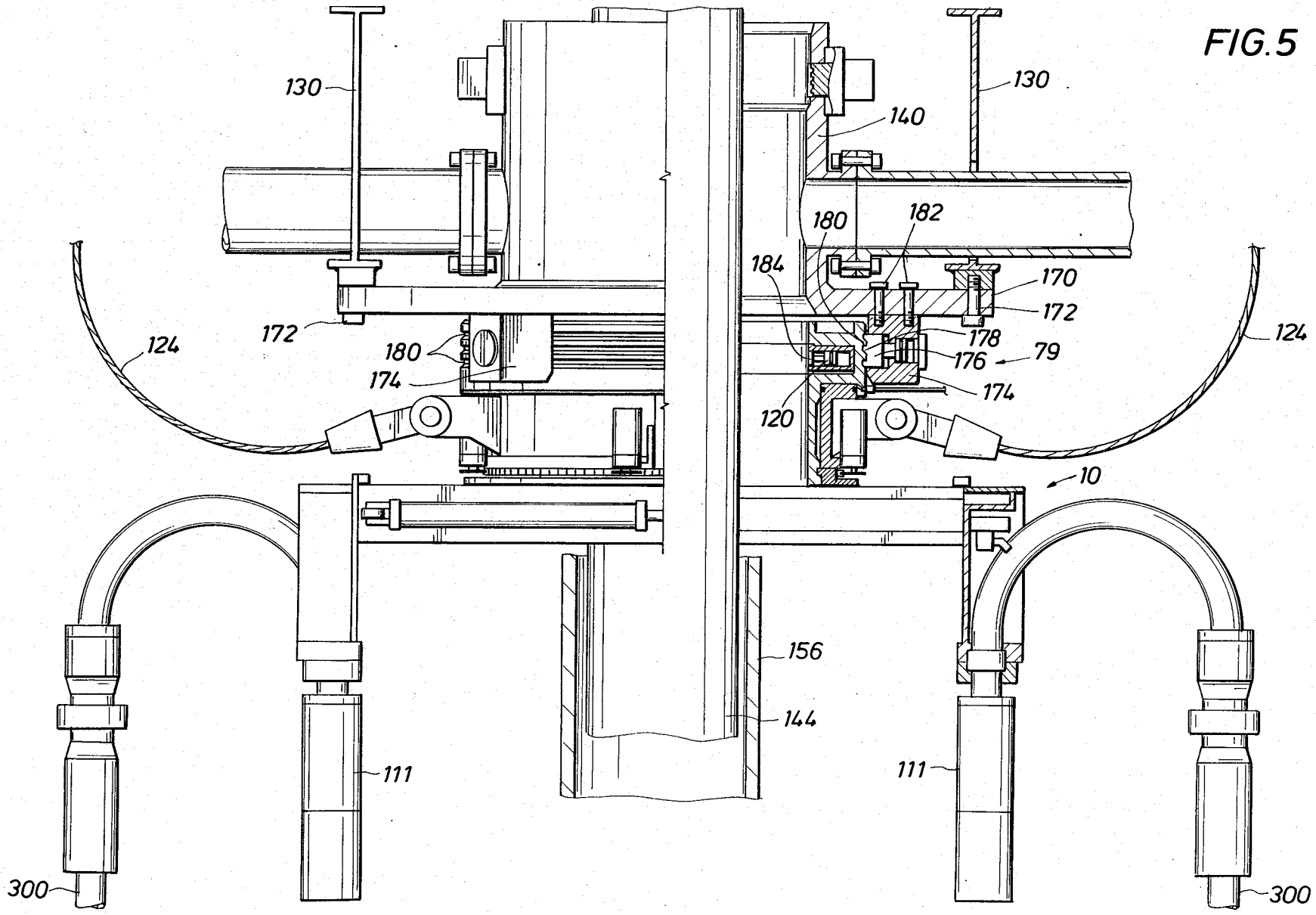
FIG. 5 illustrates in more detail the apparatus according to the invention of FIG. 3 where a stowable tension ring is supported by a supporting ring connected to the beams of the rig and shows the terminal end assembly according to the invention where drape hoses carried by the terminal end assembly have been moved outwardly and further illustrates a length of riser pipe extending through the stowable tension ring and the support housing of the rig.

FIG. 5 shows the terminal end assembly 10 and its associated stowable tension ring 79 in more detail during the running of the blowout preventer stack 141 toward the sea floor via lengths of riser pipe 144 and choke/kill lines 156. The stab connectors 111 and their associated flexible drape hoses 300 are shown moved to an outer position. The details of the preferred construction of the terminal end assembly 10 and its attachment to the stowable tension ring 79 and the means for angular and axial alignment of the stab connectors 111 with respect to the unterminated, pin ends 156' will be discussed below in connection with FIGS. 6, 6A, 8, 9 and 10. The illustration of FIG. 5 shows how the stowable tension ring 79 is releasably secured beneath the diverter or support housing 140 and to the support beams 130.

A support ring 170 is secured to the support beams 130 by means of bolts 172. Stowing brackets 174, spaced circumferentially about support ring 170, are secured to it, for example, by bolts 182. Each stowing bracket 174 includes an hydraulically actuated dog 176 having inwardly facing teeth 178. The body of the stowable tension ring 79 includes outwardly facing grooves 180 which cooperate with the teeth 178 of the hydraulically actuated dogs 176 such that when the dogs 176 are actuated, the teeth 178 fit within grooves 180 thereby securing the stowable tension ring 79 to the stowing brackets 174 for releasably securing the tension ring 79 to the support ring 170 and the rig beams 130.

Figure 6:
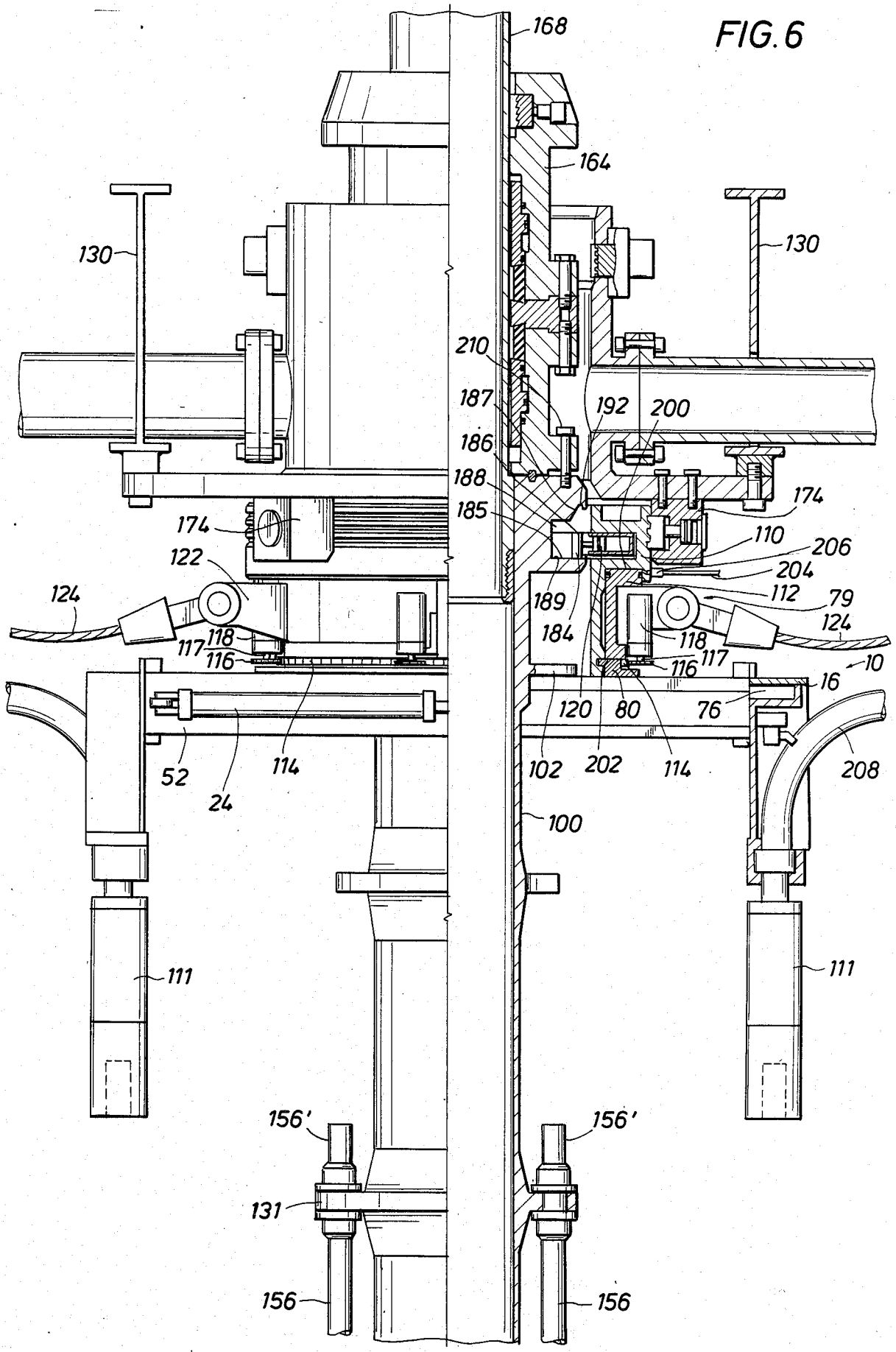
FIG. 6 shows more detail than that of the illustration of FIG. 3 where a tubular extension of the outer barrel of a telescopic joint has been connected to the uppermost length of riser pipe and has been lowered into the support housing adjacent the stowable tension ring according to the invention and dogs of the stowable tension ring have been moved inwardly within a groove of the tubular extension operationally at a time where the blowout preventer stack has not yet landed on the guide base at the sea floor and where the stowable tension ring has not yet been disconnected from the supporting ring.

FIG. 6 illustrates in more detail the condition of the terminal end assembly 10 and the tension ring 79 after the outer barrel 164 of a telescopic joint has been lowered into the support housing 140 and through the tension ring 79. A tubular tension 100 of the outer barrel 164 of the telescopic joint has a mounting flange 131 to which are fastened choke and kill lines 156 with upwardly facing unterminated pin connectos 156'. The lower end of outer barrel extension 100 and lines 156 mate with the uppermost riser joint 144. The tubular extension 100 is secured to the outer barrel 164 of the telescopic joint by means of bolts 210. The inner barrel 168 is also illustrated extending downwardly within the outer barrel 164 of the telescopic joint.

The tubular extension 100 of the outer barrel 164 of the telescopic joint preferably includes two diagonally opposed outwardly extending guide/index keys 101, 102. Such keys also may be seen in a cross-sectional plan view in FIGS. 9 and 10. The body of the tubular extension 100 above the guide/index keys 101, 102 has a groove 188 provided about its periphery. The groove 188 includes a lower surface 189 and an upper lip 192 which cooperate with pistons 120 and dogs 184 disposed about the inner periphery of the tension ring 79 to not only secure the tension ring 79 to the tubular extension 100 of the outer barrel 164 of the telescopic joint, but also to axially align the stab connectors 111 above the upwardly facing unterminated pin connectors 156' of choke/kill lines 156. The groove 188 includes a tapered surface 187 leading to upper lip 192 which aids in the centering of dogs 184 in upper lip 192 during operations, as will be explained below, of the connection of tension ring 79 to extension 100.

A source of pressurized fluid is connected to line 204 and port 206 to provide a fluid bearing at surface 200 between outer ring 112 and inner ring 110. Such fluid bearing allows relative rotation between inner ring 110 and outer ring 112 during certain operational procedures to be explained below.

During certain other operational procedures to be explained below, the inner ring and outer ring 112 move as a unit with respect to plate 80 and rotate with respect to plate 80 on its surface 202.

The tension ring 79 includes an inner ring 110 rotatably supported upon outer ring 112. As explained below, outer ring 112 rotates with respect to inner ring 110 only when the fluid bearing at surface 200 is actuated. Mounting plate 80, which is rotatably connected to inner ring 110 and outer ring 112, supports terminal end assembly 10.

Disposed in the wall of the inner ring 110 are a plurality of pistons 120 and associated dogs 184. The pistons 120 may be hydraulically actuated to move the dogs 184 inwardly into the grooves 188. The illustration of FIG. 6 shows a cross-section of one such dogs 184 moved inwardly into the groove 188 and illustrates that the tubular extension 100 (and outer barrel 164 of the telescopic joint) has been axially positioned by the rig drawworks such that the lower surface 185 of the dog 184 is approximately at the same level as the lower surface 189 of the groove 188. In this position the tension ring 79 is released from the stowing brackets 174, and is supported on groove bottom 189. The riser assembly is then lowered and the stack is landed and latched to the subsea wellhead 250.

Also illustrated in FIG. 6 is a guide/index key 102 of the tubular extension 100 of the outer barrel 164 of the telescopic joint and a guide/index slot 76 in a yoke 16 of the terminal end assembly 10 as will be illustrated in more detail below, especially with respect to FIGS. 9 and 10. The guide/index keys 102 and guide/index slots 76 of the terminal end assembly serve to angularly align the stab connectors 111 with the pin connectors 156' which have been connected to choke/kill lines 156. Alignment may also be accomplished by means of the hydraulic motors 118 secured to the outer ring 112 and having an output shaft 117 and a sprocket 116 which engages a chain 114 attached to the mounting plate 80 of the terminal end assembly 10. Such a motor/sprocket/-chain combination allows greater angular alignment corrections between the terminal end assembly 10 and the tubular extension 100 of outer barrel 164 than can be accomplished by means of the guide/index keys 102 and guide/index slots 76 apparatus. During any angular alignment of the tubular extension 100 with respect to the terminal end assembly 10, the upper surfaces 186 of the dogs 184 are in securing engagement with the top surface or lip 192 of the grooves 188 of the tubular extension 100 such that the inner ring 110 and the tubular extension 100 are angularly fixed with respect to the outer ring 112. The terminal end assembly is rotatable relative to inner ring 110 and outer barrel extension 100 by hydraulic motor 118/sprocket 116 driving chain 114 on mounting plate 80.

The mounting of the tension ring 79 to the terminal end assembly 10 by means of mounting plate 80 is shown in more detail in the perspective and cutaway view of FIG. 8 discussed below.

Figure 6A:
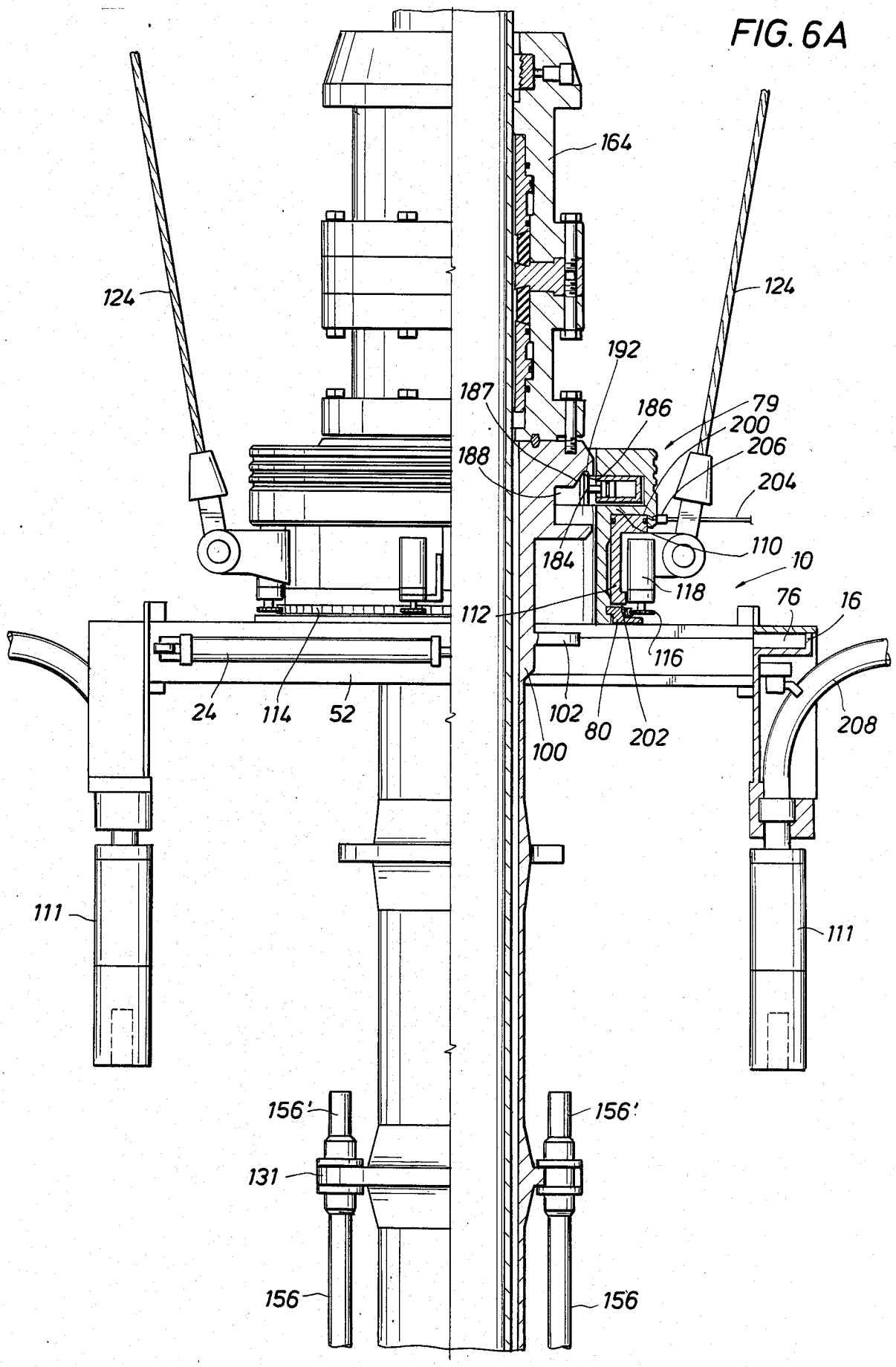
FIG. 6A illustrates the condition of the riser system where the stowable tension ring has been disconnected from the supporting ring, the blowout preventer stack has been lowered until it is landed on the guide base at the sea floor, and the tension cables attached to the stowable tension ring have been tensioned, thereby positioning the tension ring dogs at the top of the tubular extension groove and automatically vertically aligning alignment keys on the tubular extension with alignment slots on yokes of the terminal end assembly.

After the stack 141 is landed and latched to wellhead 250, tension cables 124 are pulled upwardly from rig 135 as illustrated in FIG. 6A, which causes tension ring 79 to move upwardly with respect to extension 100 of the outer barrell 164 of the telescopic joint. Inclined surfaces 187 serve to center dogs 184 as ring 79 moves upwardly until upper surfaces 186 of dogs 184 engage lip 192 of groove 188. After the dogs 184 are engaging lip 192, guide index keys 102 are properly vertically (axially) aligned with slots 76, assuring that hydraulic connectors 111 are properly axially aligned a small distance above pin ends 156'. Connectors 111 are positioned vertically below slots 16 of terminal end assembly 10 and pin ends 156' are positioned vertically below keys 101, 102 such that connectors 111 are immediately above pin ends 156' after dogs 184 are in the top surface or lip 192 of groove 188 of the tubular extension 100.

Figure 7:
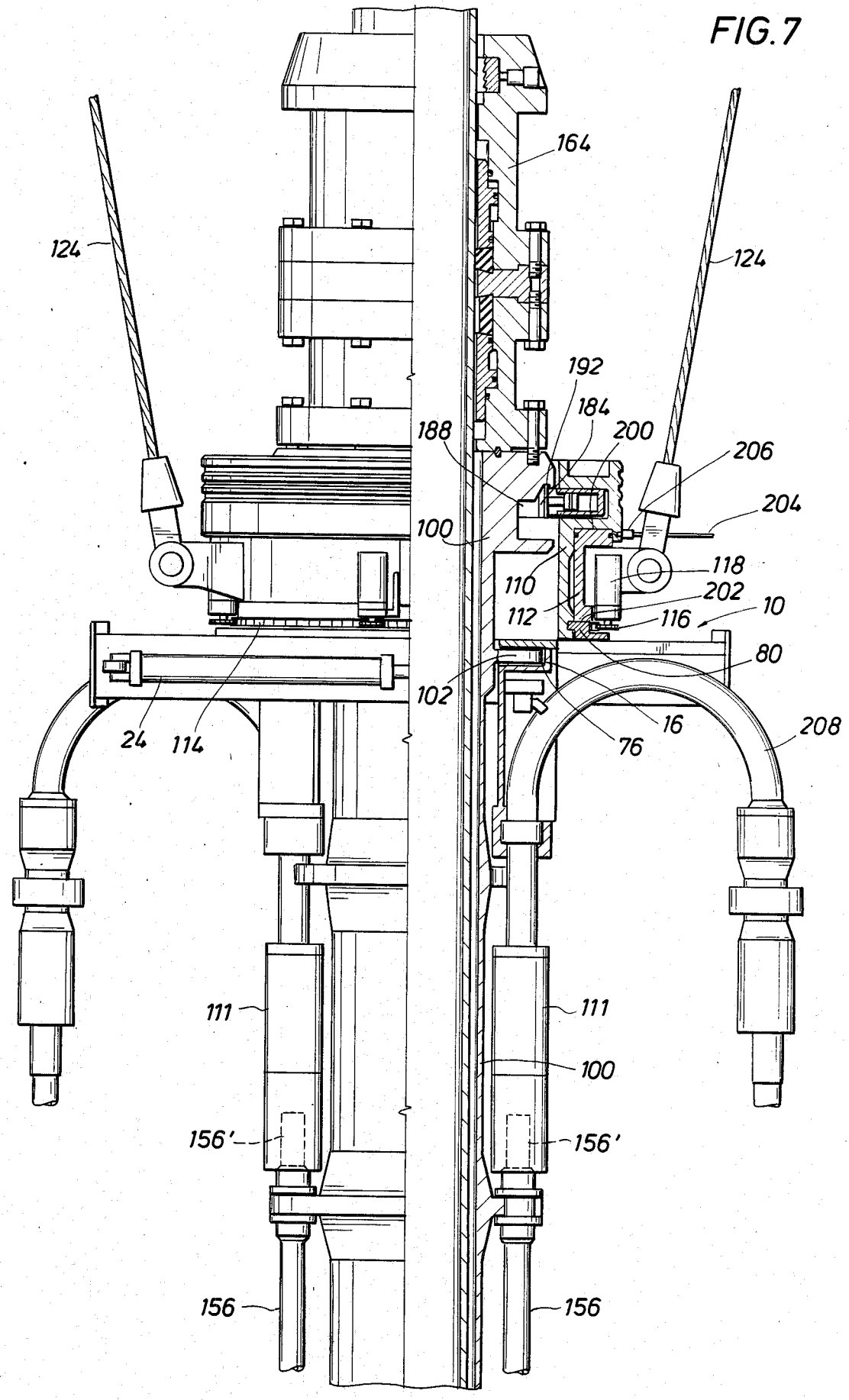
FIG. 7 illustrates more detail of the illustration of FIG. 4 and illustrates the condition of the apparatus where the outer barrel of the telescopic joint is being supported by means of tension cables and the stab connectors of the flexible drape hoses have been connected to male choke/kill ends of the tubular extension of the telescopic joint which are secured to the choke/kill lines of the uppermost riser length.

FIG. 7 illustrates in more detail the condition of the system as that illustrated in FIG. 4 after the stowable tension ring 79 has been disconnected from the stowing brackets 174 as in FIG. 6 and the further operational steps of angularly aligning keys 102 with slots 76 and the inward retraction of yokes 16. FIG. 7 shows the guide/index key 102 of the tubular extension 100 of the outer barrel 164 of the telescopic joint fully inserted into the guide/index slot 76 of the yoke 16 of the terminal end assembly 10 after the yokes 16 have been moved to their inner position. Rotation of yokes 16 and terminal end assembly 10 is accomplished by inner ring 110 and outer ring 112 being fixed as a tension ring unit and terminal end assembly 10 and its mounted plate 80 rotating with respect to the tension ring unit 79 at surface 202. During angular rotation of terminal end assembly 10 with respect to tension ring 79 and extension 100, no pressurized hydraulic fluid is applied to line 204 and port 206 thereby rendering fluid bearing surface 200 inoperable. Thus, extension 100, dogs 184, inner ring 110 and outer ring 112 all move angularly as a unit. Because of the upward tension on inner ring 110 and outer ring 112 caused by tension cables 124, plate 80 and assembly 10 are free to rotate at surface 202 with respect to inner ring 110 and outer ring 112.

Large angle rotations of plate 80/terminal end assembly 10 with respect to ring 79/extension 100 are achieved by operating hydraulic motors 118 which are connected to outer ring 112 and cause chain 114 secured about an outer periphery of plate 80 to translate or "crawl" about sprocket 116. Small angle rotations are achieved by the interaction of keys 102 with the shape of slots 76 of yokes 16 as explained specifically below with respect to FIG. 9.

As shown in FIG. 7, after the keys 102 have been inserted in slots 76, the hydraulic stab connectors 111 are axially and angularly aligned with the pin ends 156' of the outer barrel 164 of the telescopic joint. The hydraulic stab connectors 111 are then extended downwardly to engage pin connector 156'. By virtue of its connection to the riser lengths 144, the entire riser string is supported by means of tension cables 124.

Figure 8:
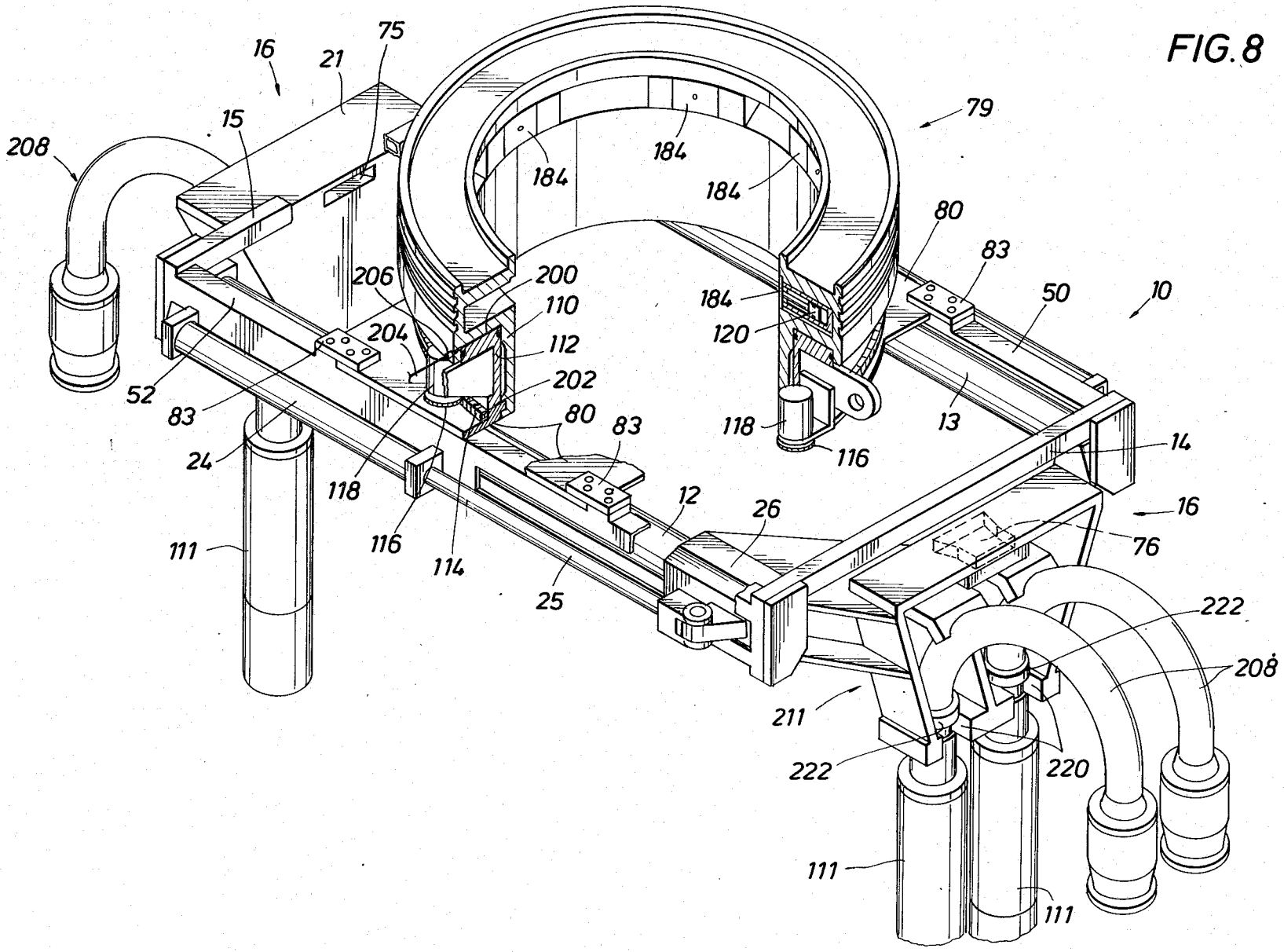
FIG. 8 is a perspective view, partly in section, of the terminal end assembly and stowable tension ring according to the invention.

FIG. 8 is a perspective view partially cut away of the terminal end assembly 10 in its open position and with the associated stowable tension ring 79 mounted thereon. the terminal end assembly 10 includes a generally rectangular frame having two longitudinal frame members 50 and 52 connected by two lateral frame members 14 and 15. Yokes 16 at each longitudinal end of the frame carry the stab connectors 111 and their associated goosenecks 208 and may be slidingly moved between an inner position (as shown in FIG. 10) and an outer position (as shown in FIGS. 8 and 9). The yokes 16 slide upon carriage rails 12 and 13 which are disposed inwardly of longitudinal frame members 52 and 50.

The perspective view of FIG. 8 shows one cylinder 24 and its rod 25 connected to a piston within the cylinder 24 for longitudinally moving outwardly and inwardly the right hand yoke 16. The right hand yoke 16 includes a first slider 26 and a second slider 27 which slide upon the carriage rails 12 and 13 inwardly of the longitudinal frame members 52 and 50. Guide/index slots 75 and 76 are illustrated in FIG. 8 and will be described with more particularity with respect to the discussion of FIG. 9.

The goosenecks 208 are secured to their respective yoke by means of a securing bracket 211 which includes counterbores 220 which accepts a gooseneck 208 through it. A split retainer flange 222 on each gooseneck 208 maintains the gooseneck 208 in the counterbore.

The stowable tension ring 79 is mounted to the frame members 50 and 52 by means of a mounting plate 80. Mounting brackets 83 secure the mounting plate 80 to the longitudinal frame members.

FIG. 8, like FIGS. 6, 6A and 7 also shows tension ring 79 with an inner ring 110 rotatably mounted upon an outer ring 112. Line 204 and port 206 provide a means to apply pressurized fluid to fluid bearing surface 200 between inner ring 110 and outer ring 112. As explained above, when the fluid bearing surface 200 is not operable, that is when no pressurized hydraulic fluid is applied to line 204, inner ring 110 and outer ring 112 are immobilized and the terminal end assembly 10/plate 80 rotate with respect to the rings at surface 202. Such rotation, facilitated by the upward pull of tension cables 124, is used as explained above in the angular alignment of the terminal end assembly 110 with respect to tubular extension 100.

After the riser string is fully connected, that is with the terminal end assembly 10 retracted inwardly with keys 101, 102 fixed in slots 75, 76 and dogs 184 in lips 192 of groove 188 of extension 100, the drilling rig vessel may change orientation. The riser string is fixed with respect to the wellhead 250 so it is desirable to be able to rotate outer ring 112 and tension cables 124 with respect to inner ring 110 in order that tension cables do not become unduly twisted. As explained above, hydraulic motors 118 fixed to the outer ring 112 include output shafts and sprockets 116 which are in engagement with chain 114 secured to the mounting plate 80. Actuation of the hydraulic motor 118 produces relative angular translation of the outer ring 112 with respect to the inner ring 110 after the yoke assemblies are retracted inwardly to engage guide/index slots 75, 76 with index keys 101, 102 and fluid bearing surface 200 is pressurized to support the riser tensioner load.

Also illustrated in FIG. 8 are the plurality of dogs 184 which are actuatable by pistons 120 shown in the cross-section cut of the perspective view. As discussed with respect to FIGS. 6 and 7, the piston 120/dog 184 arrangements serve to secure the inner ring 110 of the stowable tension ring 79 to the tubular extension 100 of the outer barrel 164 of the telescopic joint.

The stab connectors 111 may be any suitable hydraulically actuatable connector as is known in the prior art. Particular connectors which may be suitable for the application described herein is the subject of U.S. Pat. Nos. 3,704,033 or 4,469,136. The mechanical connector apparatus described in the above mentioned patent is incorporated herein.

Figure 9:
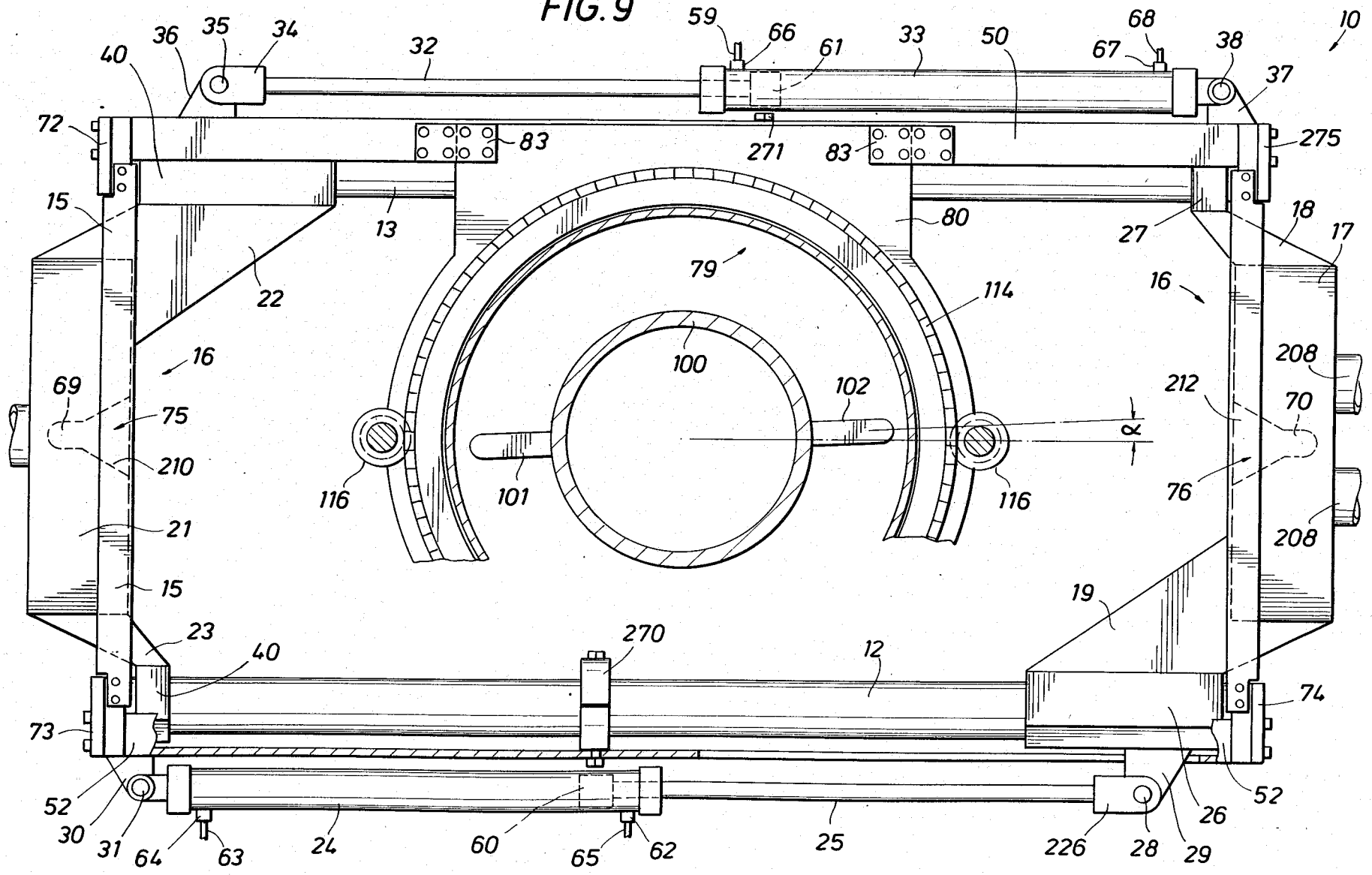
FIG. 9 is a plan view taken along the top of the terminal end assembly and illustrating yokes in an outer position shown for example in FIGS. 1, 2 and 3 and showing specifically apparatus for moving the yokes outwardly and inwardly with respect to the stowable tension ring mounted on the terminal end assembly frame.

FIG. 9 is a plan view of the terminal end assembly 10 in its open position and taken along a longitudinal line through the mounting plate 80 of the perspective view of FIG. 8 discussed above and further illustrating the placement of the tubular extension 100 of the outer barrel 164 of the telescopic joint within tension ring 79. The right hand side yoke member 16 includes a lateral yoke member 17 and cross yoke members 18 and 19. Cross yoke member 19 is terminated by a slider 26 slidingly engaging a carriage rail tube 12. A slider 27 terminating cross yoke member 18 slidingly engages carriage rail tube 13.

Similarly, the left hand yoke 16 includes a lateral yoke member 21 connected to a cross yoke member 22 and a cross yoke member 23. The cross yoke member 22 is terminated by a slider 40 which slidingly engages carriage rail 13. A slider 41 is secured to the cross yoke member 23 and slidingly engages the carriage rail tube 12.

Rod 25 is connected to a piston 60 within the cylinder 24. Ports 62 and 63 are provided on the cylinder 24 which connect respectively to pressurized hydraulic lines 64 and 65.

The rod 25 is connected to a rod clevis 226 which is connected to a bracket 29 which in turn is connected to the slider 26 of the yoke 16. The pin 28 secures the rod clevis 26 to the bracket 29. The yoke 16 may be moved to its outer position shown in FIG. 9 by applying pressurized hydraulic fluid to line 64 thereby moving piston 60 to the right and moving the right hand side yoke 16 to the outer position. A bracket 30 supports the left end of the cylinder 24 and is connected by means of a pin 31.

Similarly, the left hand yoke 16 is moved between outer and inner positions by means of the cylinder 33 having a piston 61 in it connected to rod 32. The rod 32 is connected to the a rod clevis 34 which is secured to a bracket 36 by means of a pin 35. The cylinder 33 is connected to the longitudinal frame member 50 by means of a bracket 37 and is secured thereto by a pin 38. The yoke 16 may be moved to its outer position shown in FIG. 9 by applying pressurized hydraulic fluid to line 68 thereby moving piston 61 to the left. Ports 66 and 67 are provided on the cylinder 33 which connect respectively to pressurized hydraulic lines 59 and 68.

Plates 72, 73, 74 and 275 serve to mechanically join the longitudinally frame members 50 and 52 with the lateral frame members 15 and 14. Clamps 291 and 270 secured to carriage rails 12 and 13 with longitudinal frame members 52 and 50 provide a stop for sliding yoke assemblies 16, as better illustrated in FIG. 10 when the yokes 16 are moved to the inner position.

FIG. 9 shows the tension ring 79 which is connected to the mounting plate 80 which in turn is secured to the longitudinal frame members 50 and 52 by means of mounting brackets 83. Illustrating the condition of the riser system as that of FIG. 6, FIG. 9 shows the tubular extension 100 of the outer barrel 164 of the telescopic joint within the tension ring 79. The guide/index keys 101 and 102 are provided diagonally opposed from one another and extending outwardly from the tubular body of the tubular extension 100. Also illustrated in the plan view are the unterminated pin ends 156' of the choke/-kill/mud boost lines 156.

The yokes 16 have guide/index slots 76, 75 disposed in the lateral yoke members 17 and 21. The slots include throats 70, 69 dimensioned to closely fit about the ends of the guide/index keys 101 and 102. The guide/index slots 76, 75 also include mouths 212 and 210. The mouths 212 and 210 flare outwardly from the throats 70 and 69 such that when the tubular extension 100 is angularly misaligned by a relatively small amount, the sides of the mouths 212 or 210 cause the guide/index keys to be guided into the throats 70 and 69 causing angular rotation of the terminal end assembly 10 by virtue of the rotation of mounting plate 80 relative to inner ring 110/outer ring 112/dog 184/lip 192 of tubular extension 100. Because of such rotation, the ends of the stabl connectors 111 are angularly aligned with the pin ends 156' of the choke/kill/mud boost lines 156 in that they are secured to the tubular extension 100 by virtue of the connection of tubular extension 100 to the riser length 144.

As illustrated in FIG. 9, the tubular extension 100 is angularly misaligned with respect to the throats 70 and 69 of slots 76 and 75 by an angle $\alpha$. The flaring of the slot mouths 210 and 212 are provided to allow for an angular misalignment $\alpha$ of plus or minus eight degrees ($\pm 8°$) with respect to the guide/index keys 101 and 102 and the slot throats 70 and 69.

Angular misalignments greater than plus or minus eight degrees are corrected by the hydraulic motors 118 and sprockets 116 in cooperation with the chain 114. In operation, angular misalignments greater than plus or minus eight degrees may be grossly corrected by means of the hydraulic motor 118/sprocket 116/chain 114/plate 80 apparatus and angular misalignments less than plus or minus eight degrees are corrected by means of the shape of the slot mouths 212 and 210 in cooperation with the shape of the guide/index keys 101 and 102.

Figure 10:
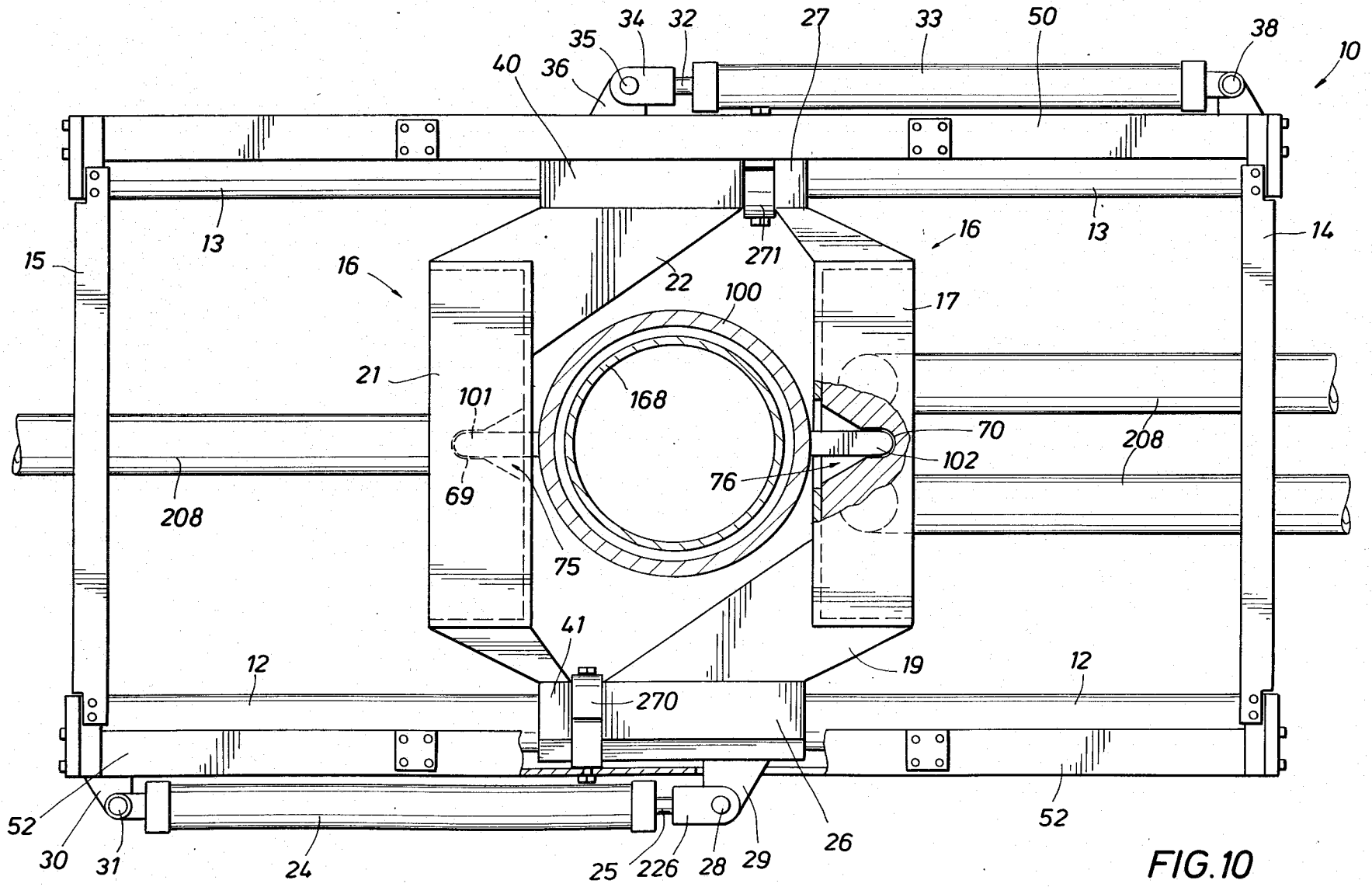
FIG. 10 is a plan view similar to that of FIG. 9 but illustrating the condition of the apparatus where the yokes have been moved inwardly and where guide keys on the outer barrel of the telescopic joint have been inserted in slots disposed in the yoke weldments for angular alignment of the stab connectors carried by the yokes with the upwardly facing unterminated choke/kill lines of the uppermost riser length.

FIG. 10 shows a plan view similar to that of FIG. 9 but after the yokes 16 have been moved to their inner position. The guide/index keys 101 and 102 are inserted laterally into the throats 69 and 70 of the slots 75 and 76. The inner barrel 168 of the telescopic joint is shown extended within the tubular extension 100 similar to that illustrated in FIG. 6.

OPERATION OF THE INVENTION

As described above, a remotely operable hydraulically actuated terminal end assembly 10 that is rotatably mounted about a stowable riser tension ring 79 is provided. In the stowed position, as illustrated in FIG. 1, the hydraulic stab connectors 111 are unlocked and disconnected. The yokes 16 to which the stab connectors 111, associated gooseneck swivels 208 and drage hoses 300 are moved to outer positions so that the drape hoses provided sufficient room in the moon pool 147 for the blowout preventer stack assembly 141. This feature allows the blowout preventer stack 141 to be trolleyed in perpendicularly to the yokes 16 from the side of the moon pool and into position under the rotary table 138, rig housing and tension ring 79/remote terminal end assembly 10.

The blowout preventer stack 141 is then connected to riser pipe lengths 144 and lowered length by length of riser pipe toward the sea floor as shown in FIG. 2.

As shown in FIG. 3, the telescopic joint is installed through the diverter housing 140 with a tubular extension 100 of its outer barrel connected to the uppermost length of riser pipe. Unterminated choke/kill or hydraulic line connectors 156' face upwardly. The tubular extension 100 passes through the stowable tension ring 79 and terminal end assembly 10. At this stage in the running of the blowout preventer stack/riser system, the stowable tension ring 79 is secured to the support ring 170 and the tension cables 124 are not tensioned.

The riser system is lowered with the telescopic joint attached until the tubular extension 100 reaches a level such that its groove 188 is opposite dogs 184 of the dog/piston system mounted in the inner periphery of inner ring 110. The blowout preventer stack 141 is a short distance from wellhead 250. The riser system is completed by installing a flex joint 206 and diverter atop the inner barrel 168 of the telescopic joint (as shown in FIG. 4). The pistons 120 are actuated, causing dogs 184 to move into groove 188. The telescopic joint-/tubular extension/riser system/blowout preventer stack is then raised a small amount until the dogs 184 are touching the bottom surface 189 of the groove 188. The stowable tension ring 79 is then disconnected from support brackets 174 by unlatching hydraulically actuated dogs 176.

The entire riser system/blowout preventer stack is then lowered until the blowout preventer stack 141 is landed within guide frame 150 and latched to wellhead 250. During this phase of operations, the tension ring 79 and terminal end assembly 10 are "riding" down with tubular extension 100 by virtue of dogs 184 within groove 188. The entire riser string during this time is being supported by the rig drawworks supporting the telescopic joint 168/164.

After the blowout preventer stack 141 is latched to wellhead 250 (see FIG. 4), tension cables 124 are tensioned from the drilling rig pulling the tension ring 79/terminal end assembly 10 upwardly. The tension ring 79 moves upwardly within groove 188 of tubular extension 100. Tapered surfaces 187 of groove 188 cause dogs 184 to center tension ring 79 with respect to tubular extension 100 until the dogs are in contact with lip 192 of groove 188. At this time the entire riser system is being supported by tension cables 124 as illustrated in FIG. 6A. Also, by this operation, guide keys 101, 102 are vertically or axially aligned with slots 76 of yokes 16 and stab connectors 111 are vertically positioned correctly so as to be properly vertically positioned immediately above pin ends 156' after the yokes are moved inwardly.

Next, if the rig operator determines that the slots 76 are misaligned more than plus or minus eight degrees, hydraulic motors 118 are operated which drive the terminal end assembly 10 into alignment with the guide keys 101, 102 of tubular extension 100 by rotating it with respect to both inner ring 110 and outer ring 112 by virtue of chain 114 "crawling" about sprocket 116. Angular misalignments of less than plus or minus eight degrees are corrected when the yokes are moved inwardly through the cooperation of guide keys 101, 102 entering slots 75, 76, of yokes 16. The flared mouths 210, 212 of slots 75, 76 move guide keys 101, 102 into throats 69, 70 of the slots, while terminal end assembly 101 rotates with respect to ring 79 (with inner ring 110, outer ring 112 fixed as a single unit) about surface 202. Yokes 16 are moved inwardly by actuation of hydraulic cylinders 24, 33 seen in FIGS. 9 and 10.

The operations described above bring yokes 16 to their inward position which angularly and axially positions the hydraulic stab connectors 111 immediately over the pin connectors 156' of the choke/kill/mud boost (or auxiliary) lines. The hydraulic stabs 111 are then actuated to engage the pin connectors 156' on the riser system and the riser system is completed by stroking the the inner barrel 168 of the telescopic joint downwardly until the diverter lands within housing 140.

During drilling operations with the blowout preventer stack 141/riser system 44, the drilling vessel/-drawworks 135 may change angular orientation about the fixed riser system. Tension cables 124 may be rotated with respect to the riser system by providing pressurized hydraulic fluid to line 204/port 206 thereby actuating fluid bearings 200. Then hydraulic motors 118 are actuated causing outer ring 112 to rotate with respect to inner ring 110. Relative rotation occurs at both surfaces 200 and 202 because, as shown in FIG. 7, terminal end assembly 10 has its plate 80 angularly fixed to tubular extension 100 in that keys 101, 102 are in slots 75, 76 of yokes 16. Likewise, dogs 184 engage lip 192 of groove 188. Thus actuation of hydraulic motors 118 cause outer ring 112 to "crawl" about plate 80 and fixed inner ring 110 providing an operational means to angularly align tension cables 124 with the riser system.

ALTERNATIVE OPERATION

The operation of the invention may be altered from that described above during the procedure of connecting the terminal end assembly 10 and stowable tension ring 79 to extension 100. Rather than inserting dogs 189 into groove 188, disconnecting tension ring 79 from stowing brackets 174, lowering riser/telescopic joint/-blowout preventer stack to the wellhead and then connecting the tension ring 79/terminal end assembly 10 to the telescopic joint, the tension ring 79/terminal end assembly 10 may be connected to the telescopic joint-/tubular joint 100 first, and then the entire system lowered and connected to the wellhead 250.

Such operation is identical with the operation described previously until the dogs 189 are inserted into grooves 188. At that point, brackets 174 are disconnected from the tension ring 79, tension cables 124 are tensioned, and the telescopic joint is lowered a short distance, until, as illustrated in FIG. 6A, dogs 189 are secured in lip 192. Next, terminal end assembly 10 is angularly aligned with respect to tubular extension 100 in the same manner as described previously. Stabs 111 are connected with pin ends 156' and then the entire system is lowered until the blowout preventer stack 141 is landed and latched on wellhead 250.

Various modifications and alterations in the described structures will be apparent to those skilled in the art of the foregoing description which does not depart from the spirit of the invention. For this reason, these changes are desired to be included in the appended claims. The appended claims recite the only limitation to the present invention and the descriptive manner which is employed for setting forth the embodiments and is to be interpreted as illustrative and not limitative.

What is claimed is:

1. Apparatus adapted for use with a floating drilling rig having a marine riser including a telescopic joint, said telescopic joint having a guide/index key, said joint having an upwardly facing unterminated connector for a riser choke/kill line, said apparatus comprising, a terminal end assembly, including:

a frame, yoke means slidably disposed on said frame for securing a drape hose terminated by a downwardly facing stab connector, means for moving said yoke means between an outer position and an inner position upon said frame, and slot means disposed on said yoke means for accepting said guide/index key of said telescopic joint when said yoke means is in said inner position, a tension ring rotatably secured to said frame including means for securing said tension ring to said telescopic joint when said telescopic joint is disposed within said tension ring, and alignment means for aligning said guide/index key with said slot means, operably insuring that said guide/index key is inserted into said slot means on said yoke means when said yoke means is moved to said inner position operably angularly aligning said stab connector with said choke/kill line.

2. The apparatus of claim 1 wherein said means for moving said yoke includes:

a cylinder secured to said frame, a piston disposed with said cylinder, a piston rod connected between said piston and said yoke means, and means for applying pressurized hydraulic fluid to said piston within said cylinder for moving said yoke means between said outer position and said inner position.

3. The apparatus of claim 1 wherein, said frame is rectangular in shape having two longitudinal frame members and two lateral frame members and includes first and second carriage rails disposed parallel to said longitudinal frame members, said yoke means includes a first yoke slidably disposed on said first and second carriage rails and a second yoke slidably disposed on said first and second carriage rails, a first drape hose terminated by a downwardly facing stab connector secured to said first yoke, and a second drape hose terminated by a downwardly facing stab connector secured to said second yoke.

4. The apparatus of claim 1 wherein said frame includes a cylindrical mounting plate, and wherein said tension ring includes an outer ring and an inner ring, each rotatably mounted on a first bearing surface of said mounting plate, and wherein said means for securing said tension ring includes at least one piston means disposed in said inner ring for inward engagement with said telescopic joint.

5. The apparatus of claim 4 wherein said inner ring and outer ring have a second bearing surface common to each other, and have means for applying pressurized hydraulic fluid to said second bearing surface operably facilitating rotation of said inner ring with respect to said outer ring when pressurized hydraulic fluid is applied.

6. The apparatus of claim 1 wherein said floating drilling rig further includes a support housing secured to rig support beams, and wherein said apparatus further comprises means for releasably securing said tension ring to said support housing.

7. The apparatus of claim 6 wherein said releasably securing means comprises:

a stowing means secured to said support housing and coaxially disposed about said tension ring, and a plurality of hydraulically actuated dogs disposed about the inner periphery of said stowing means, said dogs when actuated moving radially inwardly from the inner periphery of said stowing means into engagement with said tension ring.

8. The apparatus of claim 7 wherein the outer periphery of said tension ring includes at least one circumferential groove, and wherein each dog has at least one tooth disposed to fit within said groove when said dogs are actuated to move radially inwardly from the periphery of said stowing means.

9. The apparatus of claim 1 further comprising:

a plurality of pad-eyes disposed about the periphery of said tension ring, and a plurality of tension cables, each one of said cables secured to one of said pad-eyes.

10. The apparatus of claim 3 wherein said first yoke includes a first lateral yoke member and said second yoke includes a second lateral yoke member, and wherein said slot means comprises a first inwardly facing slot in said first lateral yoke member and a second inwardly facing slot in said second lateral yoke member.

11. The apparatus of claim 4 wherein said floating drilling rig telescopic joint includes two guide/index keys diagonally outwardly extending from its outer wall and said yoke means includes first and second yokes each of which are movable between opposed outer positions and inner positions on said frames, said slot means includes a first inwardly facing slot in said first yoke and a second inwardly facing slot in said second yoke, and wherein, said alignment means includes the shape of said first and second slots where each of said slots has a mouth which is wider than its throat whereby, where said guide/index keys of said telescopic joint are not precisely aligned with said throats of said first and second slots, said mouths cooperate with said guide/index keys when said yokes are moved to said inner position and said inner ring and said outer ring of said tension ring rotate with respect to said mounting plate of said frame until said guide/index keys enter said slot throats of said yokes.

12. The apparatus of claim 4 wherein said floating drilling rig telescopic joint includes two guide/index keys diagonally outwardly extending from its outer wall and wherein, said yoke means includes first and second yokes each of which are movable between opposed outer positions and inner positions on said frame, said slot means includes a first inwardly facing slot in said first yoke and a second inwardly facing slot in said second yoke, and wherein said alignment means includes, a chain disposed about a peripheral surface of said mounting plate, an actuatable motor secured to said outer ring, said motor having an output shaft, and a sprocket connected to said output shaft for engaging said chain, said motor when actuated rotating said mounting plate of said frame with respect to said inner ring and said outer ring of said tension ring until said guide/index keys are in gross alignment with slot mouths of said yokes.

13. Apparatus adapted for use with a floating drilling rig having a marine riser including a telescopic joint, said telescopic joint being connected above said riser and having an upwardly facing unterminated choke/kill line, said apparatus comprising, a terminal end assembly, including, a frame, yoke means slidably disposed on said frame for securing a drape hose terminated by a downwardly facing connector, and means for sliding said yoke means between an outer position and an inner position upon said frame, a tension ring secured to said frame including means for securing said tension ring to said telescopic joint when said telescopic joint is disposed within said tension ring, and means for angularly aligning said connector with said choke/kill line when said yoke means is moved to said inner position.

14. The apparatus of claim 13 further comprising, means for axially aligning said connector above said unterminated choke/kill line when said yoke means is moved to said inner position.

15. Apparatus adapted for use with a floating drilling rig having a marine riser, said riser having a choke/kill line, said apparatus comprising, a telescopic joint connected to the top of said marine riser, said telescopic joint having a generally cylindrical tubular body for connection to said marine riser and an upwardly facing connector for connection to said choke and kill line, a guide/index key extending radially outwardly from a lower portion of said body, and an axial alignment and securing groove disposed at least partially circumferentially on an upper portion of said body, a terminal end assembly, including a frame, yoke means slidably disposed on said frame for carrying a drape hose terminated by a downwardly facing connector, means for moving said yoke means between an outer position upon said frame and an inner position upon said frame, and slot means disposed on said yoke means for accepting said guide/index key of said telescopic joint when said yoke means is in said inner position, a tension ring rotatably mounted to said frame and disposed around said tubular body of said telescopic joint and including at least one piston disposed in the inner periphery of said ring, a securing dog secured to said piston, said dog having an upper surface and a lower surface, and means for moving said piston inwardly of said ring thereby moving said dog into said groove of said telescopic joint, and means for supportingly engaging said dog within said groove of said telescopic joint.

16. The apparatus of claim 15 wherein said floating drilling rig further includes a support housing secured to rig support beams, and wherein said apparatus further comprises means for releasably securing said tension ring to said support housing.

17. The apparatus of claim 16 wherein said groove has an axial height greater than the axial height of said securing dog thereby facilitating entry of said dog into said groove when said telescopic joint is inserted into said ring while said tension ring is secured to said support housing.

18. The apparatus of claim 17 further comprising, a plurality of pad-eyes disposed about the periphery of said tension ring, and a plurality of tension cables, each one of said cables being secured to one of said pad-eyes.

19. The apparatus of claim 18 wherein said axial alignment and securing groove includes an upper lip and a lower shoulder, and wherein when said tension ring is released from said support housing and tension is applied to said tension cables, said upper surface of said securing dog engages said upper lip of said alignment and securing groove, thereby securing said tension ring to said telescopic joint and operably axially aligning said downwardly facing connector with said upwardly facing connector.

20. The apparatus of claim 19 wherein said axial alignment and securing groove includes a conical portion between said lower shoulder and said upper lip for centering said tension ring about said telescopic joint when said tension ring is pulled upwardly by said tension cables as said dogs engage said upper lip.

21. The apparatus of claim 19 wherein the axial distance between the bottom of said downwardly facing connector and said lower surface of said securing dog is less than the axial distance between an end of said upwardly facing choke/kill line connector and said lower shoulder of said groove, whereby when said yoke is moved to said inner position and said guide/index key is inserted within said slot means, said downwardly facing connector is axially above said upwardly facing choke/kill line connector.

22. The apparatus of claim 15 further comprising, a cylinder secured to said frame, a piston disposed within said cylinder, a piston rod connected between said piston and said yoke means, and means for applying pressurized hydraulic fluid to said piston within said cylinder for moving said yoke means between said outer position and said inner position.

23. The apparatus of claim 15 wherein, said frame is rectangular in shape having two longitudinal frame members and two lateral frame members and includes first and second carriage rails disposed parallel to said longitudinal frame members, said yoke means includes a first yoke slidably disposed on said first and second carriage rails and a second yoke slidably disposed on said first and second carriage rails, a first drape hose terminated by a downwardly facing connector secured to said first yoke, and a second drape hose terminated by a downwardly facing connector secured to said second yoke.

24. The apparatus of claim 16 further comprising, alignment means for aligning said guide/index key with said slot means operably insuring that said guide/index key is inserted into said slot means on said yoke means when said yoke means is moved to said inner position operably angularly aligning said downwardly facing connector with said upwardly facing choke/kill line connector.

25. The apparatus of claim 24 further comprising, a mounting plate secured to said terminal end assembly frame, an outer ring rotatably mounted to said mounting plate, and an inner ring rotatably mounted upon said outer ring and upon said mounting plate.

26. The apparatus of claim 25 wherein said releasably securing means comprises:

a stowing ring secured to said support housing and coaxially disposed about said tension ring, and a plurality of hydraulically actuated dogs disposed about the inner periphery of said stowing ring, said dogs when actuated moving radially inwardly from the inner periphery of said stowing ring for engagement with said tension ring.

27. The apparatus of claim 26 wherein the outer periphery of said tension ring includes at least one circumferential groove, and wherein each dog has at least one tooth disposed to fit within said groove when said dogs are actuated to move radially inwardly from the periphery of said stowing ring.

28. The apparatus of claim 23 wherein, said first yoke includes a first lateral yoke member and said second yoke includes a second lateral yoke member, and wherein said slot means comprises a first inwardly facing slot in said first lateral yoke member and a second inwardly facing slot in said second lateral yoke member.

29. The apparatus of claim 25 wherein, said telescopic joint includes two guide/index keys diagonally outwardly extending from said tubular body, said yoke means includes a first yoke slidably disposed on said frame and a second yoke slidably disposed on said frame, said first and second yokes each being movable between opposed outer positions and inner positions on said frames, said slot means includes a first inwardly facing slot in said first yoke and a second inwardly facing slot in said second yoke, and wherein, said alignment means includes the shape of said first and second slots where each of said slots has a mouth which is wider than its throat whereby, where said diagonally disposed guide/index keys of said telescopic joint are not precisely aligned with said throats of said first and second slots, said slot mouths cooperate with said guide/index keys when said yokes are moved to said inner position and said inner ring and said outer ring rotate together about said terminal end assembly frame until guide/index keys enter said slot throats of said yokes.

30. The apparatus of claim 25 wherein said telescopic joint includes two guide/index keys diagonally outwardly extending from said tubular body, said yoke means includes a first yoke slidably disposed on said frame and a second yoke slidably disposed on said frame, said first and second yokes each being movable between opposed outer positions and inner positions on said frame, said slot means includes a first inwardly facing slot in said first yoke and a second inwardly facing slot in said second yoke, and wherein said alignment means includes, an actuatable motor secured to said outer ring, said motor having an output shaft, and a chain disposed about a peripheral surface of said mounting plate, engaging means connected to said output shaft for engaging said chain and rotating said outer ring and said inner ring of said tension ring with respect to said mounting plate of said frame until said guide/index keys are in gross alignment with said slot mouths of said yokes.

31. A method for installing a blowout preventer stack and riser system including riser pipes and attached choke/kill lines to the sea floor from a floating drilling rig having a moon pool and a support housing connected to support beams of the rig and having a stowable tension ring releasably secured to said housing and having an hydraulically actuated terminal end assembly rotatably mounted to said tension ring, the terminal end assembly having drape hoses terminated by stab connectors mounted thereon and movable between outer positions and inner positions, the method comprising the steps of, moving said stab connectors to the outer positions of said terminal end assembly, moving a blowout preventer stack at the moon pool of the drilling ring to a position beneath said support housing, stowable tension ring, and terminal end assembly, lowering a first length of riser including choke/kill lines through said support housing and said stowable tension ring, connecting said first length of riser pipe and choke/-kill lines to said blowout preventer stack, connecting other lengths of riser pipe including choke/kill lines via said support housing end to end to said first length of riser until said blowout preventer stack is near the sea floor, connecting a telescopic joint to the uppermost length of riser pipe and connecting unterminated choke/-kill line connectors to said choke/kill lines of the uppermost riser length unterminated, said telescopic joint having a generally cylindrical tubular body and a guide/index key extending radially outwardly from said body, lowering said telescopic joint through said support housing and said tension ring, and securing said tension ring to said cylindrical tubular body of said telescopic joint.

32. The method of claim 31 wherein said securing step includes the substeps of actuating dogs disposed about the inner periphery of said tension ring into a groove disposed about the outer periphery of said tubular body, disconnecting said tension ring from said housing, lowering said blowout preventer stack and said riser with said tension ring and said terminal end assembly being carried by said dogs within said groove until said blowout preventer stack is landed and connected to a wellhead at the sea floor, raising said tension ring and said terminal end assembly by tension cables until said dogs are secured at the top of said groove, and angularly aligning said stab connectors above said choke/kill line connectors by rotating said terminal end assembly with respect to said tension ring.

33. The method of claim 32 further comprising the step of connecting said hydraulic stab connectors to said choke/kill line connectors.

34. The method of claim 32 wherein said tension ring includes an outer ring and an inner ring, each rotatably mounted on a first bearing surface of a mounting plate disposed on said terminal end assembly, said outer ring having said tension cables connected to it, said inner ring and said outer ring having a second bearing surface common to each other, and having means for applying pressurized hydraulic fluid to said second bearing surface for facilitating rotation of said inner ring with respect to said outer ring when pressurized hydraulic fluid is applied, and after said terminal end assembly and said tension ring have been secured to said cylindrical tubular body of said telescopic joint, further comprising the steps of, applying pressurized hydraulic fluid to said bearing surface, and rotating said outer ring with respect to said inner ring so as to rotate said tension cables with respect to said riser where said floating drilling rig has changed orientation with respect to said riser.

* * * * *